US008863975B2

(12) United States Patent
McCanless

(10) Patent No.: US 8,863,975 B2
(45) Date of Patent: Oct. 21, 2014

(54) WASTE CONTAINER

(71) Applicant: Rehrig Pacific Company, Los Angeles, CA (US)

(72) Inventor: Margaret McCanless, Atlanta, GA (US)

(73) Assignee: Rehrig Pacific Company, Los Angeles, CA (US)

( * ) Notice: Subject to any disclaimer, the term of this patent is extended or adjusted under 35 U.S.C. 154(b) by 0 days.

(21) Appl. No.: 13/691,914

(22) Filed: Dec. 3, 2012

(65) Prior Publication Data

US 2013/0334229 A1 Dec. 19, 2013

Related U.S. Application Data

(60) Provisional application No. 61/566,270, filed on Dec. 2, 2011.

(51) Int. Cl.
*B65D 45/18* (2006.01)
*B65D 41/02* (2006.01)

(52) U.S. Cl.
CPC ..... *B65D 41/02* (2013.01)
USPC ..... 220/324

(58) Field of Classification Search
USPC ..... 220/324; 16/230, 231; 292/194, 110, 292/247, 256.69, DIG. 49
See application file for complete search history.

(56) References Cited

U.S. PATENT DOCUMENTS

| | | | | | |
|---|---|---|---|---|---|
| 1,015,455 | A * | 1/1912 | Neesham | 220/8 |
| 1,719,343 | A * | 7/1929 | Strayer | 292/87 |
| 2,574,384 | A * | 11/1951 | George | 229/125.23 |
| 3,516,572 | A * | 6/1970 | Davis Paul | 220/781 |
| 4,034,884 | A * | 7/1977 | White | 220/8 |
| 4,877,150 | A * | 10/1989 | Otto et al. | 220/304 |
| 5,127,523 | A * | 7/1992 | Herdlicka | 206/370 |
| 5,373,959 | A * | 12/1994 | Haasewinkel | 220/324 |
| 5,906,292 | A * | 5/1999 | Rider, Jr. | 220/839 |
| 7,445,116 | B2 * | 11/2008 | Dansaert et al. | 206/366 |
| 8,038,025 | B2 * | 10/2011 | Stark et al. | 220/254.3 |
| 8,267,278 | B2 * | 9/2012 | Tucker et al. | 220/785 |
| 2005/0139090 | A1 * | 6/2005 | Clougherty | 99/467 |

* cited by examiner

*Primary Examiner* — Andrew Perreault
*Assistant Examiner* — Mollie Llewellyn
(74) *Attorney, Agent, or Firm* — Carlson, Gaskey & Olds

(57) ABSTRACT

A container includes a container body having a base and walls extending upward from the base to define a container interior and an open upper end. A lid extends over at least a portion of the upper end of the container body. The lid is movable between an open position and a closed position. A latch selectively secures the lid in the closed position. The latch includes a first latched position and a second latched position, which may be more secure than the first latched position. The lid may be a primary lid or a secondary, sub-lid within the primary lid.

10 Claims, 7 Drawing Sheets

WASTE CONTAINER

BACKGROUND OF THE INVENTION

The present invention relates to a reusable container, such as a container for biohazards such as medical waste.

A medical waste container may include a container body having a base and walls extending upward from the periphery of the base. A lid may close at least a portion of a mouth of the container body.

During use, the lid may be repeatedly opened and closed. When the container is full, the lid should be secured closed tightly and securely for removal and emptying.

SUMMARY

A container includes a container body having a base and walls extending upward from the base to define a container interior and an open upper end. A lid extends over at least a portion of the upper end of the container body. The lid is movable between an open position and a closed position. A latch selectively secures the lid in the closed position. The latch includes a first latched position and a second latched position. The lid may be a primary lid or a secondary, sub-lid within the primary lid.

The lid may be temporarily latched in the first position, such as when the lid will be repeatedly opened and closed during use. The lid may be more tightly secured in the closed position by the latch in the second position, such as when the container is full and needs to be removed, replaced and shipped to be emptied.

DETAILED DESCRIPTION OF THE PREFERRED EMBODIMENT

Figure 1:
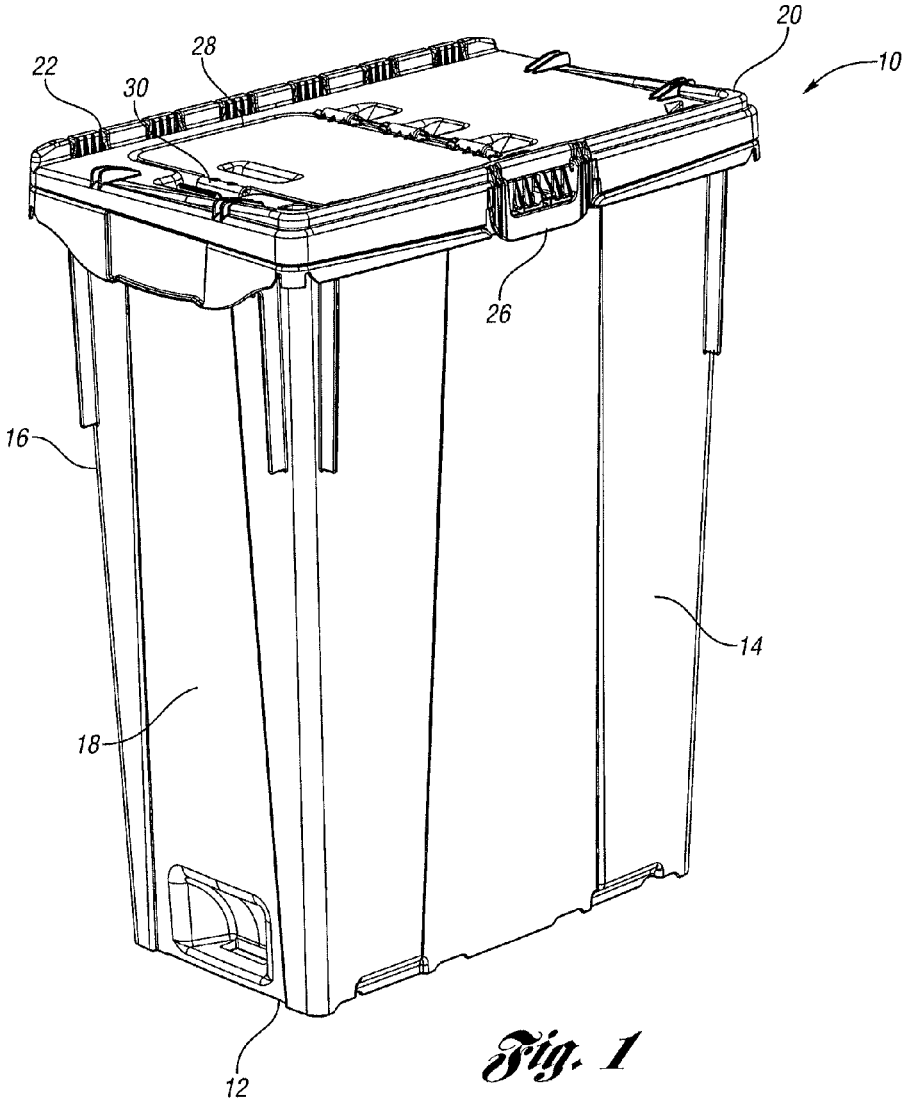
FIG. 1 is a perspective view of an example reusable biohazard waste container that includes the subject invention.

A container 10 is shown in FIG. 1. The container 10 can be used as a containment receptacle for transporting and/or collecting regulated wastes in a healthcare environment. The container includes a container body having a bottom wall 12, a front wall 14, a rear wall 16 (not visible), and a pair of side walls 18 that extend up from the bottom wall 12 and connect the front wall 14 to the rear wall 16 to form a box-shaped container with an open upper end.

Figure 10:
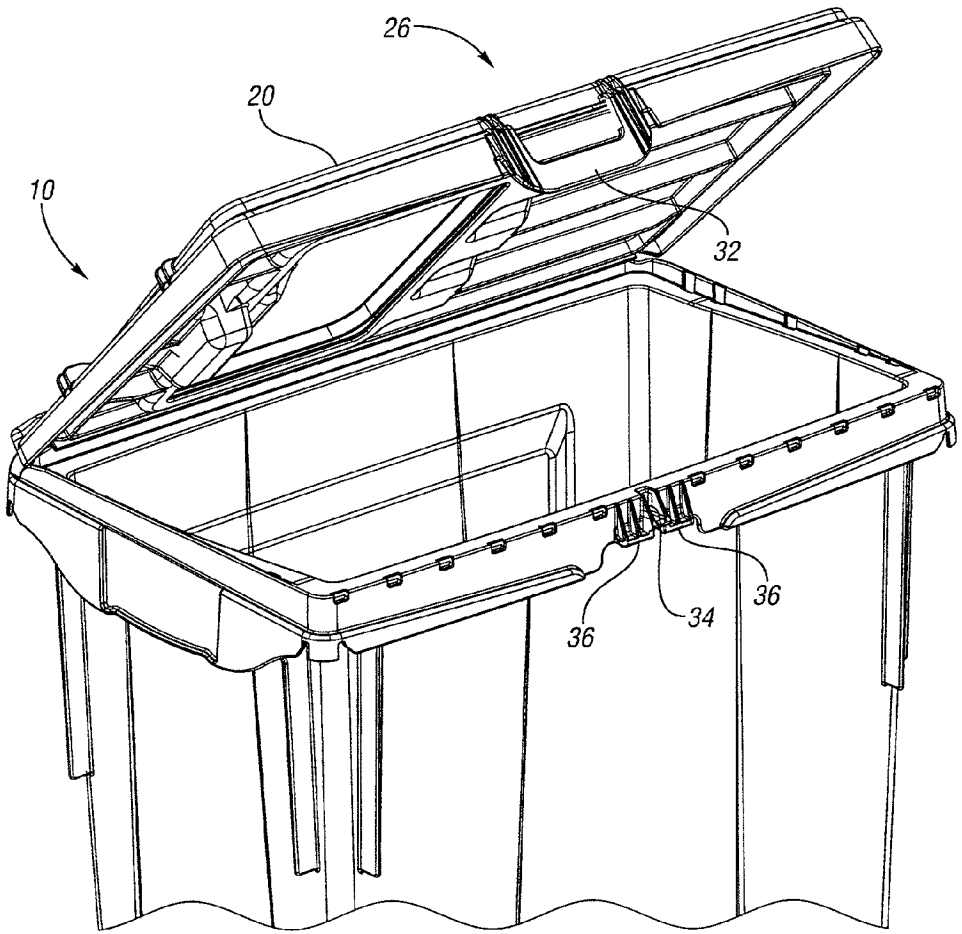
FIG. 10 is a perspective view showing latch of the primary lid in the unlatched position and the primary lid open.

A primary lid 20 is attached to the rear wall 16 at a hinged connection 22. The lid 20 is moveable between a closed position as shown in FIG. 1 and an open position (FIG. 10). A latch 26 is used to secure the lid 20 to the container 10 in the closed position. A secondary lid or sub-lid 28 is hingeably mounted to the lid 20 over an opening through the lid 20. A latch 30 selectively secures the sub-lid 28 in the closed position. The container body, the lid 20 and the sub-lid 28 are each integrally molded as a separate, single piece of plastic.

Figure 3:
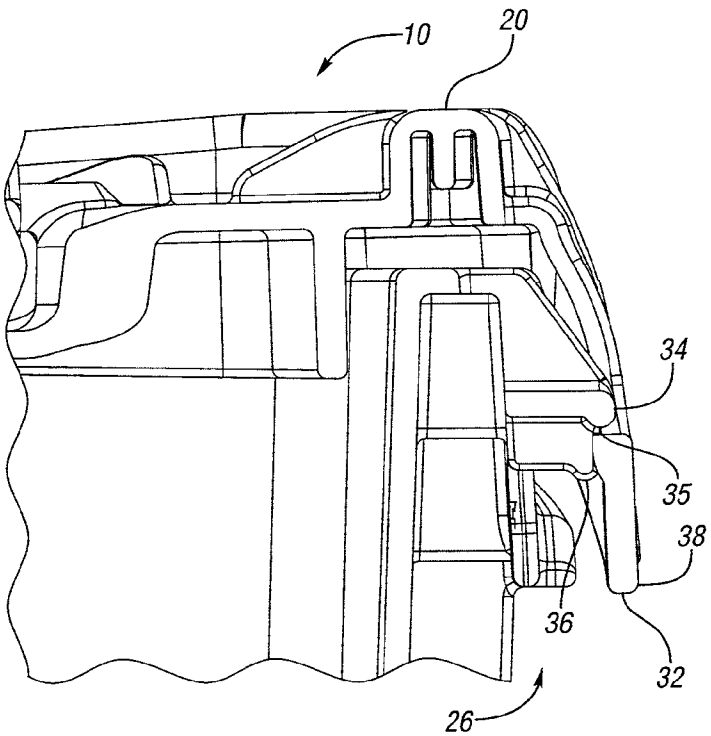
FIG. 3 is a section view through the latch of FIG. 2.
Figure 2:
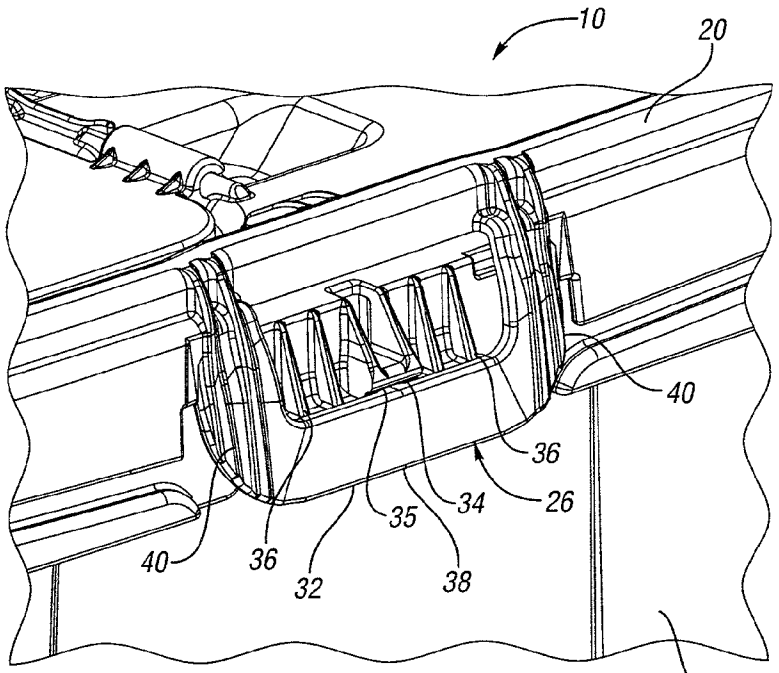
FIG. 2 is an enlarged view of the latch of the container of FIG. 1 in a first position.

FIG. 2 is an enlarged view of the latch 26 of the container 10 of FIG. 1 in a first latched position. The latch 26 includes a first latch member 32, a second latch member 34 and a third latch member 36. The first latch member 32 may be integral with the lid 20 and may include a flexible portion 38 extending between arm portions 40. The second latch member 34 may be integrally molded with the container body. The second latch member 34 projects forward from an upper edge of the front wall 14. The third latch member 36 may also be integrally molded with the container body and projects forward from the upper edge of the front wall 14. As shown in FIGS. 2 and 3, the first latch member 32 may be selectively positioned (e.g. snapped past a downward-protruding ridge 35 at a forward edge thereof) under the second latch member 34 to retain the lid 20 in the closed position. As can be seen more clearly in FIG. 3, the third latch member 36 has a lower most edge below that of the second latch member 34 (and slightly rearward/inward thereof). The lid 20 may be temporarily latched in this manner.

Figure 5:
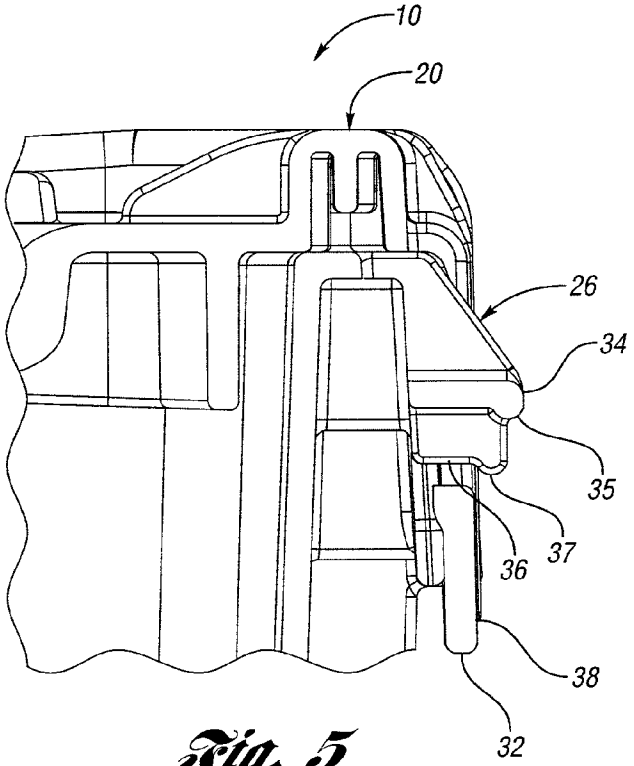
FIG. 5 is a section view through the latch of FIG. 4.
Figure 4:
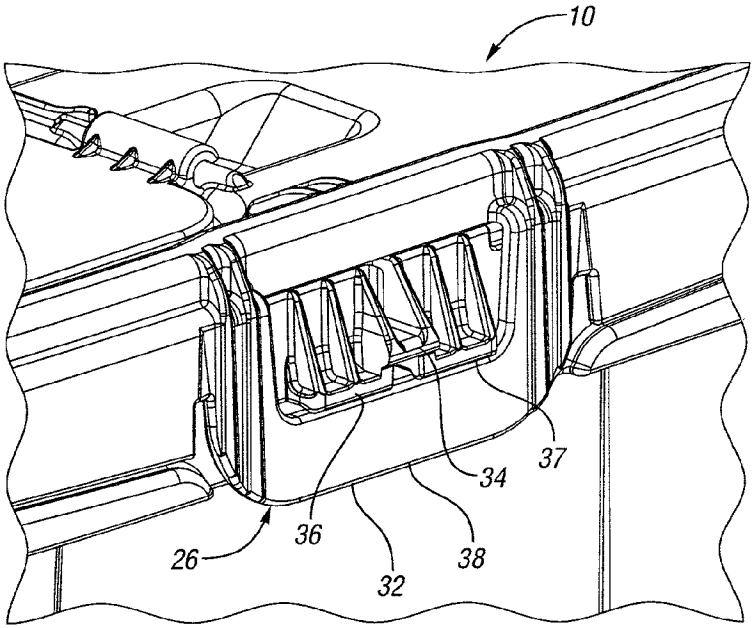
FIG. 4 is an enlarged view of the latch of the container of FIG. 1 in a second position.

FIG. 4 is an enlarged view of the latch 26 of the container 10 of FIG. 1 in a second position with the first latch member 32 below the third latch member 36 (e.g. snapped past a downward-protruding ridge 37 at the forward edge thereof). FIG. 5 is a section view through the latch 26 of FIG. 4. The lid 20 may be more tightly secured in the closed position by the latch 26 in this manner.

It should be noted that the parts of the latch 26 could be switched, such that the first latch member 32 could be part of the container body, while the second and third latch members 34, 36 could be part of the lid.

Figure 7:
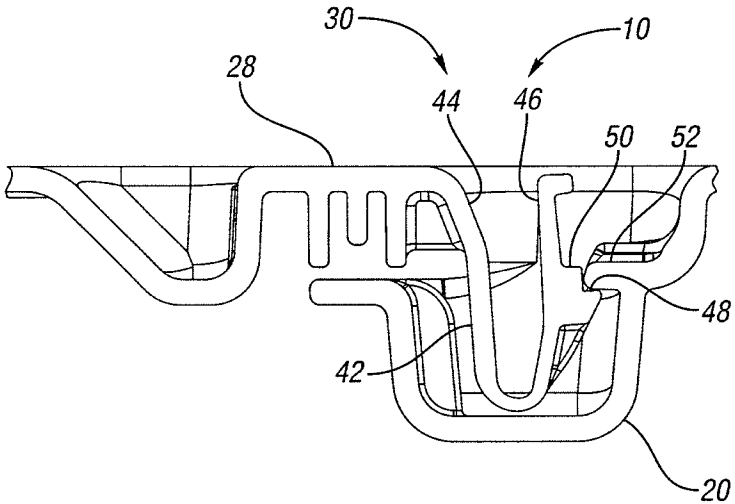
FIG. 7 is a section view through the latch of FIG. 6.
Figure 6:
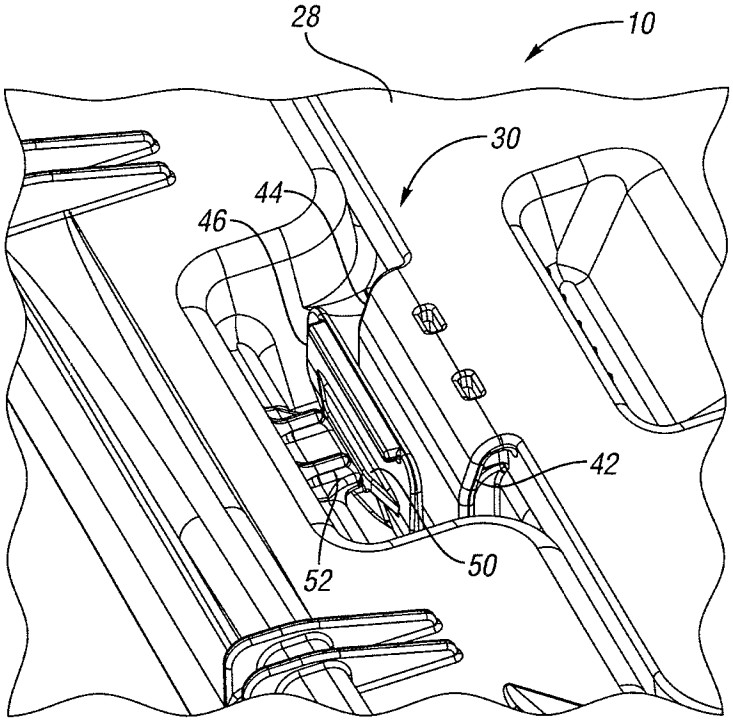
FIG. 6 is an enlarged view of the latch for the sub-lid of the container of FIG. 1 in a first position.

FIG. 6 is an enlarged view of the latch 30 for the sub-lid 28 of the container 10 of FIG. 1 in a first latched position. FIG. 7 is a section view through the latch 30 of FIG. 6. The latch 30 includes a U-shaped latch member 42 having a first leg 44 and a second leg 46 spaced away from the first leg. The first leg 44 is spaced from but can be flexed toward and away the second leg 46. A first latch member 52 protrudes rearward from the lid 20 toward the first leg 44. The first leg 44 includes second latch member 48 and a third latch member 50 projecting forward from the second leg 46. The second latch member 48 is forward of and below the third latch member 50. The second latch member 48 and the third latch member 50 selectively engage the first latch member 52. As shown in FIG. 7, the second latch member 48 can be selectively placed (i.e. snapped) below the first latch member 52 to retain the sub-lid 28 in the closed position. This may be considered a temporary closure of the sub-lid 28, i.e. a position where the sub-lid 28 will be repeatedly opened and closed during use.

Figure 9:
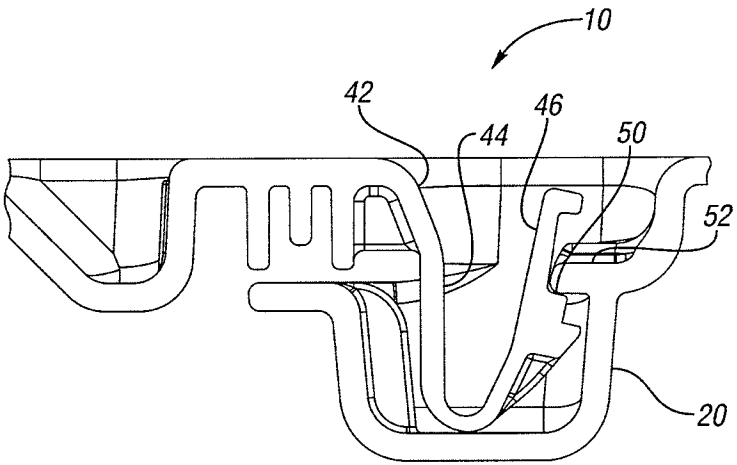
FIG. 9 is a section view through the latch of FIG. 8.
Figure 8:
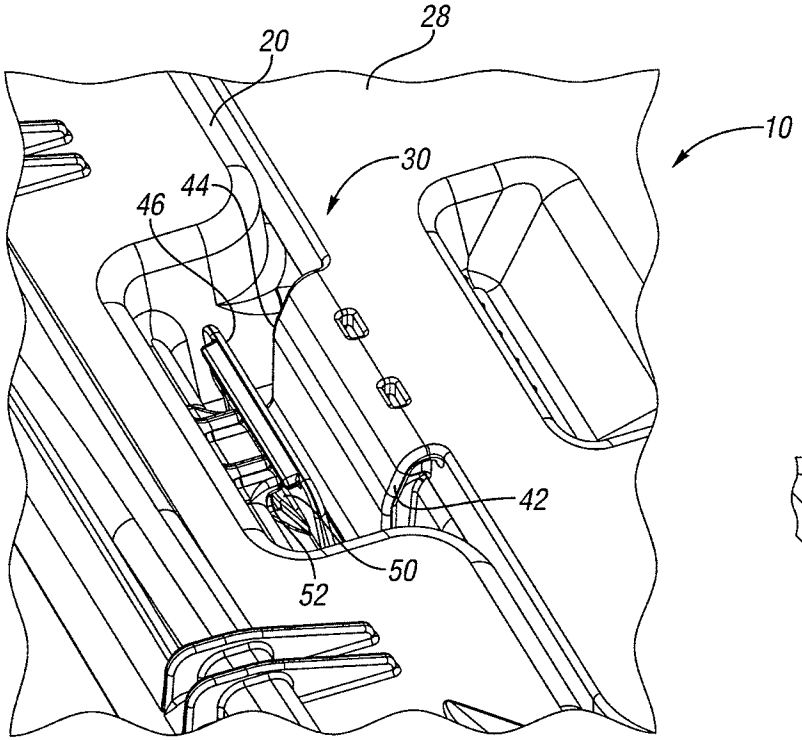
FIG. 8 is an enlarged view of the latch for the sub-lid of the container of FIG. 1 in a second position.

FIG. 8 is an enlarged view of the latch 30 for the sub-lid 28 of the container 10 of FIG. 1 in a second position. FIG. 9 is a section view through the latch 30 of FIG. 8. The U-shaped latch member 42, particularly the second leg 46 of the U-shaped latch member 42, is pressed downward, deflecting the second leg 46 downward past the first position to a position where the third latch member 50 is lodged below the first latch member 52. This may be considered a more permanent closure of the sub-lid 28, i.e. when the container 10 is full and ready to be emptied.

It should be noted that alternatively the first latch member 52 could be on the leg 46 on the U-shaped latch member 42 and the second and third latch members 48, 50 could be on the lid 20.

FIG. 10 is a perspective view showing the latch 26 of the lid 20 in the unlatched position and the lid 20 open.

Figure 11:
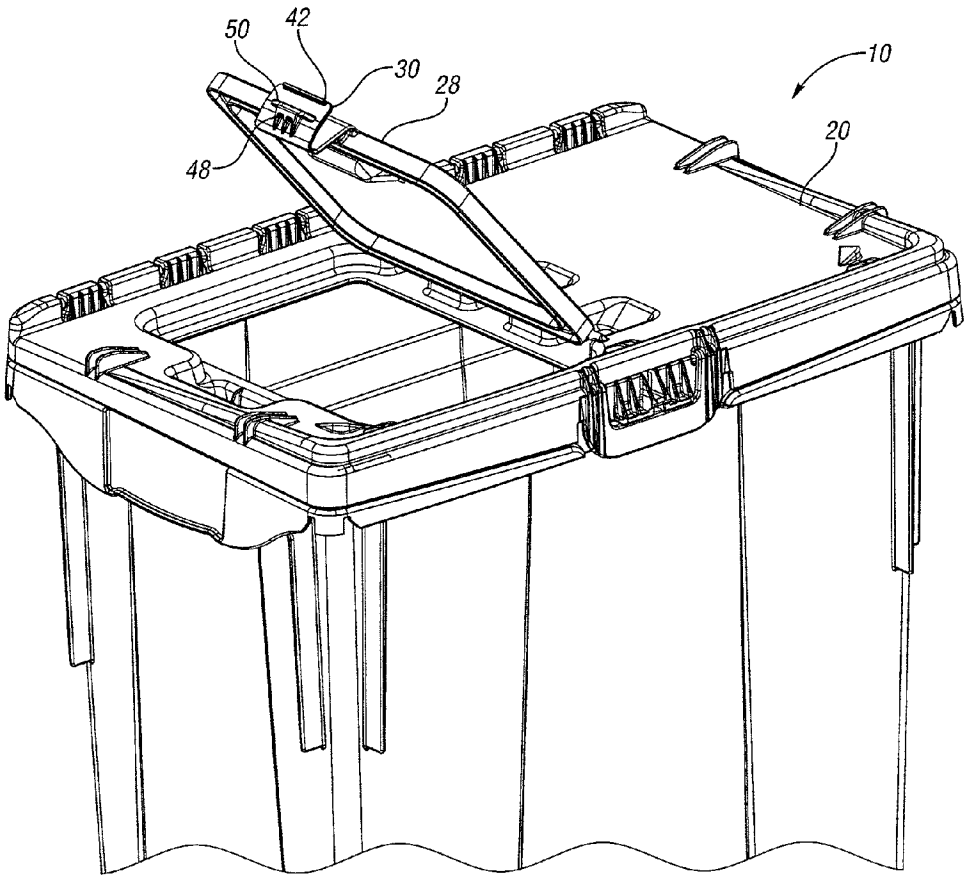
FIG. 11 is a perspective view of the container showing the latch of the sub-lid in the unlatched position and the sub-lid open.

FIG. 11 is a perspective view of the container showing the latch 30 of the sub-lid 28 in the unlatched position and the sub-lid 28 open.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope. Alphanumeric identifiers for steps in method claims are for ease of reference in dependent claims and do not signify a required sequence unless otherwise stated.

What is claimed is:

1. A container comprising:

a container body having a base and walls extending upward from the base to define a container interior and an open upper end;

a lid over at least a portion of the upper end of the container body, the lid hingeably connected to the container body, the lid movable between an open position and a closed position, wherein the lid extends completely about a peripheral upper edge of the walls of the container body when in the closed position, the lid including a lip extending downward from a front edge of the lid around an upper portion of the walls, an opening formed in the lip; and a latch selectively securing the lid in the closed position, the latch received in the opening of the lip when the lid is in the closed position, the latch including a first latched position and a second latched position, the latch including a first portion integrally molded with the lid, and a second portion integrally molded with the container body, the first portion disposed in the opening of the lip.

2. The container of claim 1 wherein the latch includes a first latch member, a second latch member and a third latch member and wherein the second latch member is secured to the first latch member when in the first latched position and wherein the third latch member is secured to the first latch member when in the second latched position.

3. The container of claim 2 wherein the lid is closed more tightly when in the second latched position.

4. The container of claim 1 wherein the lid is a primary lid and includes an opening therethrough, the container further including a sub-lid selectively closing the opening.

5. A container comprising:

a container body having a base and walls extending upward from the base to define a container interior and an open upper end;

a lid over at least a portion of the upper end of the container body, the lid movable between an open position and a closed position, the lid including a lip extending downward from a front edge of the lid around an upper portion of the walls, an opening formed in the lip; and a latch selectively securing the lid in the closed position, the latch including a first latched position and a second latched position, wherein the latch includes a first latch member, a second latch member and a third latch member and wherein the second latch member is secured to the first latch member when in the first latched position and wherein the third latch member is secured to the first latch member when in the second latched position, wherein the first latch member is integrally molded with the lid and wherein the second latch member and the third latch member are integrally molded with the container body, and wherein the first latch member is in the opening of the lip.

6. The container of claim 5 wherein the third latch member has a lower edge below a lower edge of the second latch member, and wherein the first latch member is secured below the lower edge of the second latch member when in the first latched position, and wherein the first latch member is secured below the third latch member when in the second latched position.

7. The container of claim 6 wherein the lower edge of the third latch member is rearward of the lower edge of the second latch member.

8. The container of claim 7 wherein the first latch member includes a generally horizontal flexible portion extending between two arm portions.

9. The container of claim 8 further including a downward-protruding ridge at a forward edge of the third latch member.

10. The container of claim 9 further including a downward-protruding ridge at a forward edge of the second latch member.

* * * * *